US011092171B2

(12) United States Patent
Tevis

(10) Patent No.: US 11,092,171 B2
(45) Date of Patent: Aug. 17, 2021

(54) VALVE ASSEMBLY WITH MECHANICAL AND ELECTRO-HYDRAULIC CONTROL

(71) Applicant: Caterpillar Inc., Deerfield, IL (US)

(72) Inventor: Ethan M. Tevis, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 165 days.

(21) Appl. No.: 16/218,840

(22) Filed: Dec. 13, 2018

(65) Prior Publication Data

US 2020/0190771 A1 Jun. 18, 2020

(51) Int. Cl.

| | |
|---|---|
| ***F15B 13/04*** | (2006.01) |
| ***E02F 9/22*** | (2006.01) |
| ***F15B 11/046*** | (2006.01) |
| ***F15B 13/043*** | (2006.01) |

(52) U.S. Cl.

CPC ..... *F15B 13/0402* (2013.01); *E02F 9/2203* (2013.01); *F15B 11/046* (2013.01); *F15B 13/043* (2013.01); *F15B 2013/0409* (2013.01); *F15B 2211/324* (2013.01)

(58) Field of Classification Search

CPC ..... F15B 11/046; F15B 11/048; F15B 11/10; F15B 13/0402; F15B 2013/0409; F15B 13/043; F15B 13/0431; F15B 2211/324

See application file for complete search history.

(56) References Cited

U.S. PATENT DOCUMENTS

| | | | | |
|---|---|---|---|---|
| 3,434,390 | A * | 3/1969 | Weiss | F15B 13/0436 91/51 |
| 4,011,891 | A * | 3/1977 | Knutson | F15B 9/08 137/625.62 |
| 4,274,443 | A * | 6/1981 | Faix | F15B 13/0402 137/625.6 |
| 4,627,468 | A * | 12/1986 | Wilke | G05G 5/02 137/625.64 |
| 6,041,673 | A | 3/2000 | Schmillen | |
| 7,062,832 | B2 * | 6/2006 | Yo | F15B 9/09 29/407.05 |
| 7,980,269 | B2 * | 7/2011 | Fry | B61D 7/28 137/625.64 |
| 10,202,987 | B2 * | 2/2019 | Strobel | F16K 11/07 |
| 10,323,659 | B2 * | 6/2019 | Slattery | A61G 13/02 |
| 2015/0020905 | A1 * | 1/2015 | Strobel | F16K 31/44 137/625.64 |

FOREIGN PATENT DOCUMENTS

| | | | |
|---|---|---|---|
| CN | 103062440 | A | 4/2013 |
| CN | 203145084 | U | 8/2013 |
| CN | 101769275 | B | 6/2014 |
| CN | 106149792 | A | 11/2016 |
| JP | 2002250303 | A | 9/2002 |
| KR | 101155705 | B1 | 6/2012 |

* cited by examiner

*Primary Examiner* — Michael Leslie

(57) ABSTRACT

A hydraulic valve assembly including a main control valve having a valve body housing a valve member that is movable between a first valve position and a second valve position. The hydraulic valve assembly further includes a mechanical interface operatively coupled to the movable valve member to manually move the movable valve member between the first valve position and the second valve position and one or more electro-hydraulic actuators operatively coupled to the movable valve member to automatically move the movable valve member between the first valve position and the second valve position in response to receiving a control signal from a controller.

18 Claims, 3 Drawing Sheets

VALVE ASSEMBLY WITH MECHANICAL AND ELECTRO-HYDRAULIC CONTROL

TECHNICAL FIELD

The present disclosure relates generally to a hydraulic control system on a machine, such as construction equipment, and, more particularly, to a hydraulic control system having a valve assembly with mechanical and electro-hydraulic control.

BACKGROUND

Earthmoving machines such as motor graders and wheel loaders include many hand-operated mechanical controls to perform functions such positioning an implement or a blade in several orientations, articulating the frame of the machine, and adjusting other machine settings. In many of these earthmoving machines, hydraulic systems and hydraulic actuators are used to perform the desired function, such as change the position of an implement. The hand-operated mechanical control may, for example, be a mechanical lever that opens a mechanical valve to route hydraulic fluid to a hydraulic actuator.

In some instances, it may be desirable to automate the mechanical control of certain functions. To do so, it is known to provide an electrically-controlled valve in parallel with the mechanical valve that can be automated to operate independently of the mechanical valve to route hydraulic fluid to a hydraulic actuator. The additional valves, wiring, controllers, and hydraulic lines needed make automating the mechanical control systems in this manner is costly and complex.

Chinese Utility Model CN203145084U describes an anti-electric shock safety system for an excavator. The system includes a main hydraulic pump, a pilot hydraulic pump, an oil drive solenoid valve the receives the pilot hydraulic pump output, a controller, and an electricity warning device mounted near the end of the excavator stick for detecting the presence of a strong electric cable. If the warning device detects the presence of a strong electric cable, the warning device sends a signal to the controller and the controller actuates the solenoid to immediately cut off the output from the oil drive solenoid valve, which stops the excavator from operating.

SUMMARY OF THE DISCLOSURE

One aspect of the present disclosure is directed to a hydraulic valve assembly including a main control valve having a valve body housing a valve member that is movable between a first valve position and a second valve position. The hydraulic valve assembly further includes a mechanical interface operatively coupled to the movable valve member to manually move the movable valve member between the first valve position and the second valve position and one or more electro-hydraulic actuators operatively coupled to the movable valve member to automatically move the movable valve member between the first valve position and the second valve position in response to receiving a control signal from a controller.

Another aspect of the present disclosure is directed to a hydraulic system for a machine. The system includes a hydraulic pump, a main control valve configured to receive high pressure hydraulic fluid from the hydraulic pump and route the high pressure hydraulic fluid to one of a hydraulic actuator, a hydraulic cylinder, or a hydraulic motor. The main control valve includes a valve body and a valve member movable within the valve body between a first valve position and a second valve position, a mechanical interface operatively coupled to the movable valve member to manually move the movable valve member between the first valve position and the second valve position, and one or more electro-hydraulic actuators operatively coupled to the movable valve member to automatically move the movable valve member between the first valve position and the second valve position in response to a control signal. A controller is communicatively coupled to the one or more electro-hydraulic actuators and is configured to selectively send the control signal to the one or more electro-hydraulic actuators.

Yet another aspect of the present disclosure is directed to a method of controlling a hydraulic control valve having a movable valve member. The method includes operatively coupling a mechanical interface to a movable valve member, fluidly coupling a pilot hydraulic valve with the valve member, operatively coupling an electric drive solenoid to the pilot hydraulic valve, and moving the movable valve member from a first valve position to a second valve position by one of manually moving the mechanical interface from a first interface position to a second interface position or by actuating the electric drive solenoid to open the pilot hydraulic valve to direct pressurized hydraulic fluid to act on the movable valve member.

Other features and aspects of this disclosure will be apparent from the following description and the accompanying drawings.

BRIEF DESCRIPTION OF THE DRAWINGS

Further features and advantages of the invention will become apparent from the description of embodiments using the accompanying drawings. In the drawings.

DETAILED DESCRIPTION

Figure 1:
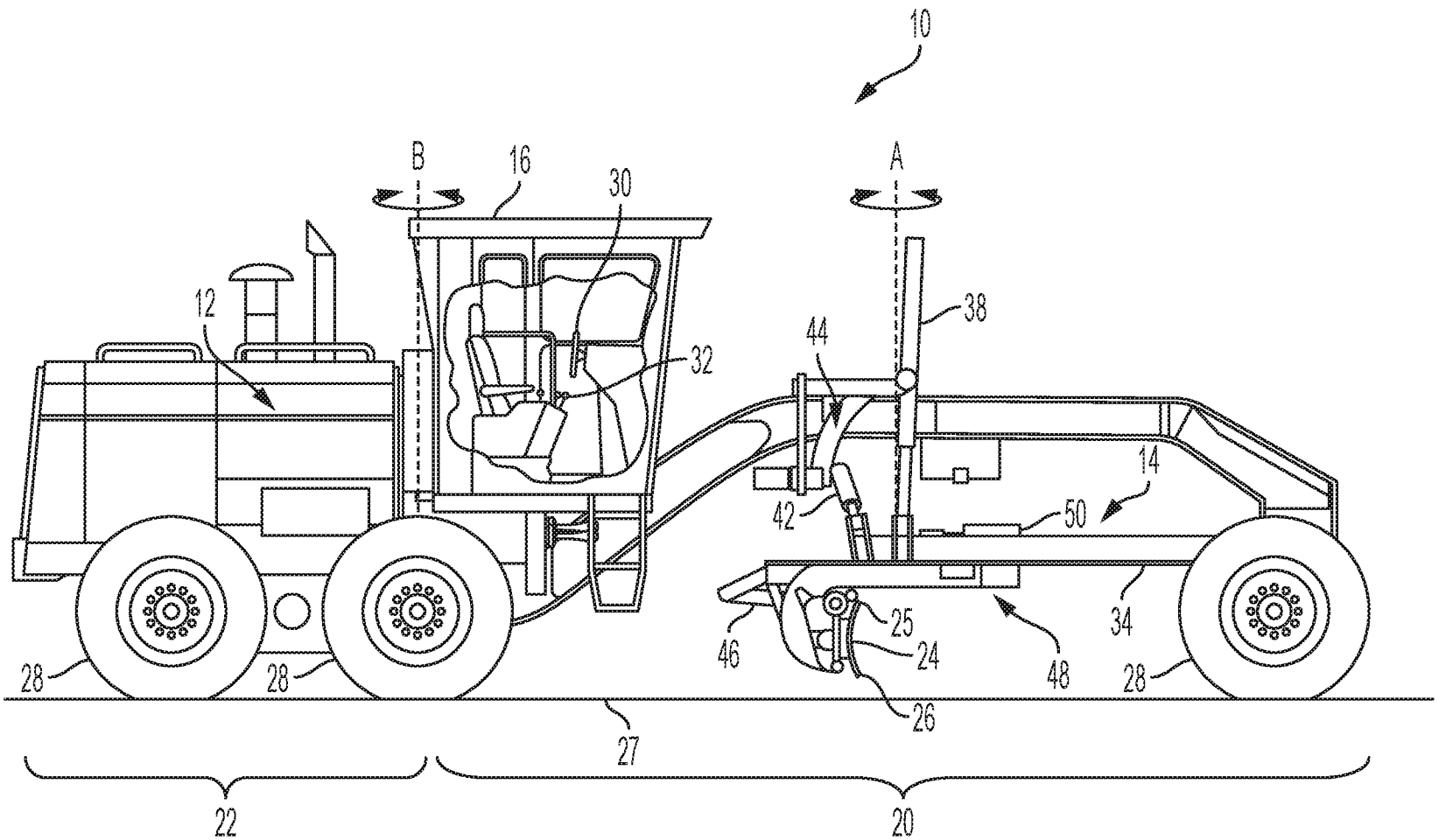
FIG. 1 is a side view of an exemplary embodiment of a machine.

Referring to the drawings, FIG. 1 illustrates an exemplary embodiment of a machine 10. The term "machine" may refer to any machine, such as a fixed or mobile machine, that performs some type of operation associated with an industry such as mining, construction, farming, transportation, or any other industry known in the art. For example, the machine 10 may be an earth moving machine such as a motor grader (shown in FIG. 1), a backhoe, a loader, material handler or any other earth moving machine.

The machine 10 may include a power source 12, a linkage arrangement 14 driven by the power source 12, and an operator station 16 situated for control of the power source 12 and/or the linkage arrangement 14. The power source 12 is used to drive and/or power the machine 10. The power source 12 may embody an engine such as, for example, a diesel engine, a gasoline engine, a gaseous fuel-powered engine or any other type of combustion engine known in the art. It is contemplated that the power source 12 may alternatively embody a non-combustion source of power such as a fuel cell, a power storage device, or another source known in the art. The power source 12 may produce a mechanical or electrical power output that may then be converted to hydraulic pneumatic power for moving the linkage arrangement 14.

The machine 10 includes a front frame 20, a rear frame 22, and a blade 24 having a top portion 25 and a cutting edge 26. The front frame 20 and the rear frame 22 are supported above a ground surface 27 by a plurality of tires 28. The operator station 16, which is mounted on the front frame 20, includes various controls used to operate the machine 10, including a steering wheel 30 and a plurality of hand controls 32, such as levers. The power source 12 is mounted on the rear frame 22. The blade 24, sometimes referred to as a moldboard, is used to move earth and is mounted on a linkage arrangement 14.

The linkage arrangement 14 allows the blade 24 to be moved to a variety of different positions with respect to the machine 10. The linkage arrangement 14 includes a drawbar 34 pivotally mounted to the front frame 20 via a ball joint. The position of the drawbar 34 is controlled by three hydraulic cylinders. In particular, a right lift cylinder 38, a left lift cylinder (not shown), and a center shift cylinder 42. A coupling 44, connects the right lift cylinder 38, a left lift cylinder (not shown), and a center shift cylinder 42 to the front frame 20. The coupling 44 can be moved during blade repositioning but is fixed stationary during earthmoving operations. The height of the blade 24 with respect to the ground surface 27 below the machine 10 is controlled primarily with the right lift cylinder 38 and the left lift cylinder (not shown). Each of the right lift cylinder 38 and the left lift cylinder (now shown) functions to raise and lower the associated end of the blade 24. Thus, the right lift cylinder 38 raises and lowers the right end of blade 24 and the left lift cylinder (now shown) raises and lowers the left end of blade 24. The center shift cylinder 42 moves the drawbar 34 from side to side relative to the front frame 20.

The linkage arrangement 14 includes a circle gear 48 and a hydraulic motor drive 50 configured to rotate the circle gear 48. Rotation of the circle gear 48 pivots the blade 24 about an axis A fixed to the drawbar 34. The blade 24 is mounted to a hinge (not shown) on the circle gear 48 with a bracket (not shown). A hydraulic blade tip cylinder 46 is used to pitch the bracket forward or rearward and thus pitch the top portion 25 of the blade 24 forward and rearward relative to the cutting edge 26. The blade 24 is mounted to a sliding joint in the bracket allowing the blade 24 to be slid or shifted from side to side with respect to the bracket.

Figure 2:
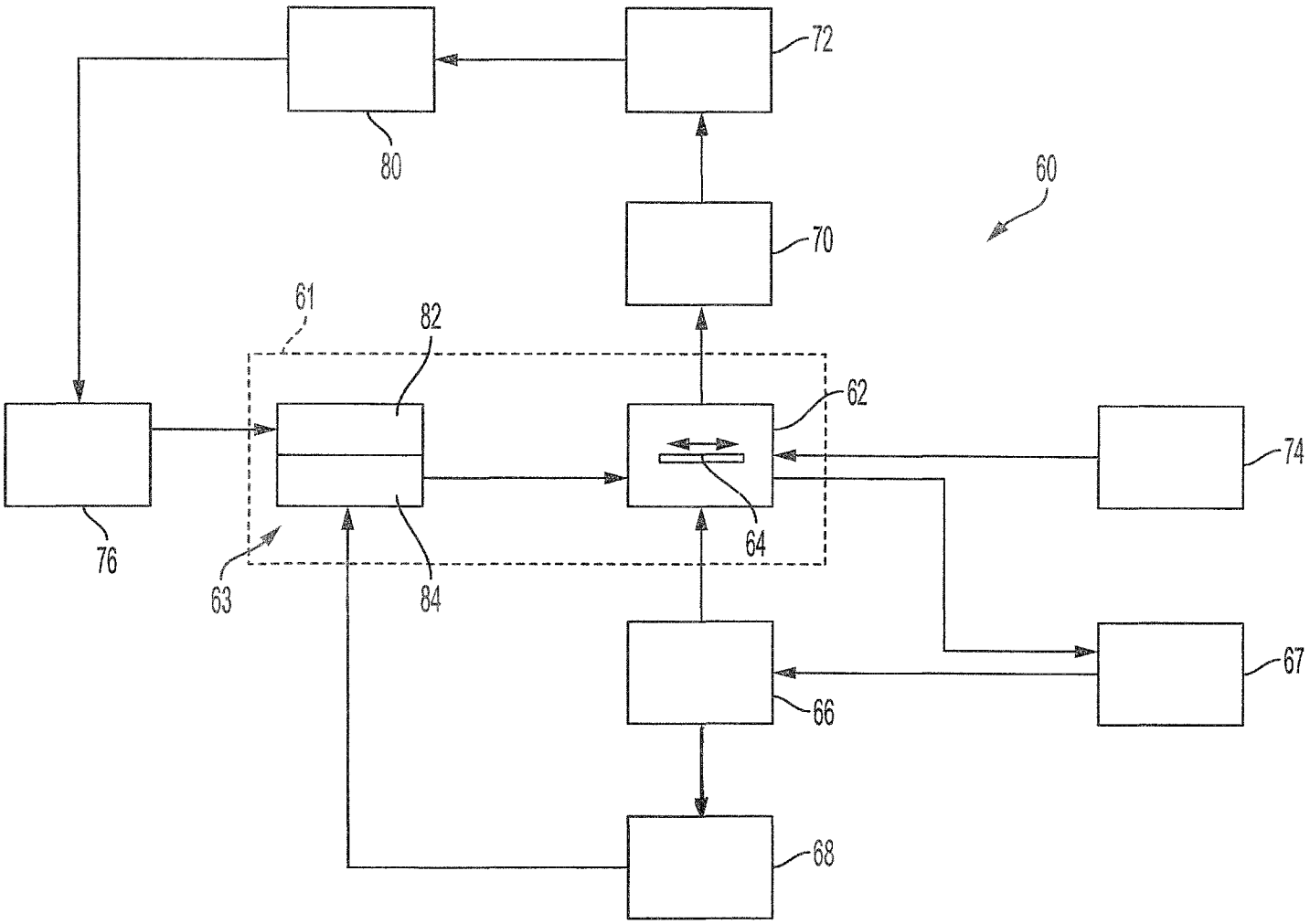
FIG. 2 is a schematic block diagram of an exemplary embodiment of electro-hydraulic control system for the machine.
Figure 3:
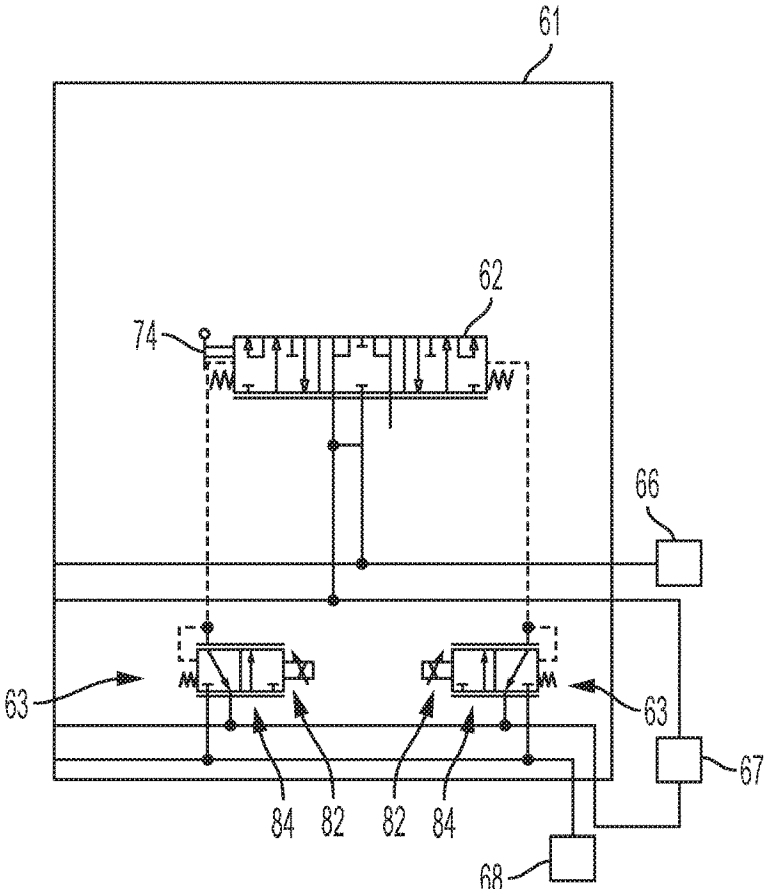
FIG. 3 is a of a hydraulic schematic of an exemplary embodiment of an hydraulic valve arrangement of the electro-hydraulic control system of FIG. 2.

FIGS. 2-3 illustrates an exemplary electro-hydraulic control system 60 for the machine 10. The control system 60 is designed to operate the various hydraulic controls of the machine 10 described above. The control system 60 may include a plurality of hydraulic valves and/or hydraulic valve assemblies. For simplicity, FIG. 2 shows a single hydraulic valve assembly 61 including a main hydraulic valve 62 and one or more electro-hydraulic actuators 63. It will be understood, however, that the control system 60 may include additional hydraulic valves and/or additional hydraulic valve assemblies.

The main hydraulic valve 62 may be configured in a variety of ways. Any suitable valve capable of being controlled, both manually and automatically, to selectively route hydraulic fluid to a component, system, implement, or the like of the machine 10 may be used. For example, in the illustrated embodiment of FIG. 3, the main hydraulic valve 62 is three-way directional valve that is both lever-operated and solenoid pilot operated. Referring to FIG. 2, the main hydraulic valve 62 includes a movable valve member 64. The movement of the movable valve member 64 regulates the flow of hydraulic fluid through the main hydraulic valve 62.

The hydraulic portion of the control system 60 provides both high hydraulic pressure and low pilot pressure. High hydraulic pressure is provided by one or more hydraulic pumps 66 that are in fluid communication with a reservoir 67 or other source of hydraulic fluid. The one or more hydraulic pumps 66 may be driven by the power source 12 of the machine 10. Any suitable type of hydraulic pumps 66 may be used that are capable of providing the desired high hydraulic pressure and volume. Low pilot pressure is provided by a hydraulic pressure reducing valve 68 that receives high hydraulic pressure from the hydraulic pump 66 and reduces the pressure to a desired pressure for use as pilot hydraulic pressure. Alternatively, one or more low-pressure hydraulic pumps may be used to provide low pilot pressure.

The main hydraulic valve 62 receives high hydraulic pressure from the hydraulic pump 66 and selectively routes the high hydraulic pressure to one or more hydraulic actuators, cylinders, and motors 70, such as for example, the lift cylinders 38 and the hydraulic motor drive 50 or back to the reservoir 67. The hydraulic actuators, cylinders, and motors 70 receive the high hydraulic pressure from the main hydraulic valve 62 and produce mechanical force to move a portion of the machine or an implement 72, such as for example, the front frame 20 of the machine 10, the linkage arrangement 14, and the blade 24 or other implements.

The main hydraulic valve 62 can be both manually controlled and automatically controlled. For manual control, the main hydraulic valve 62 is configured to be actuated by a mechanical interface 74, such as a handle, lever, foot pedal, or other suitable hand or foot control. The mechanical interface 74 is operatively coupled to the movable valve member 64 to change the position of the movable valve member 64 in order to selectively route hydraulic fluid to the one or more hydraulic actuators, cylinders, and motors 70 or back to the reservoir 67. The mechanical interface 74 may be operatively coupled to the movable valve member 64 in any suitable way known in the art. For example, the mechanical interface 74 may be mechanically linked to the movable valve member 64.

For automatic control, the control system 60 includes a controller 76 electrically connected to the one or more electro-hydraulic actuators 63. The controller 76 can be any suitable processing device. The controller 76 may be part of the electro-hydraulic control system 60 adapted to monitor various operating parameters and to regulate various variables and functions affecting the operation of the machine. Alternatively, the controller 76 may be a specialized controller, separate from the electro-hydraulic control system 60. The controller 76 can be general purpose processor, a digital signal processor (DSP), application specific integrated circuit (ASIC), a field programmable gate array (FPGA) or other programmable logic device, discrete gate or transistor logic, discrete hardware components, or any combination thereof designed to perform the functions described herein. A general purpose processor may be a microcontroller, but in the alternative, the controller 76 may be any processor, controller, microprocessor, or state machine. A controller may also be implemented as a combination of computing devices, for example, a combination of a DSP and a microcontroller, a plurality of microprocessors, one or more microcontrollers in conjunction with a DSP core, or any other such configuration. The controller 76 can include functions, steps, routines, data tables, data maps, charts and the like saved in and executed from any type of computer-readable medium, such as a memory device (e.g., random access, flash memory, and the like), an optical medium (e.g., a CD, DVD, BluRay®, and the like), firmware (e.g., an EPROM), or any other storage medium.

The one or more of the hydraulic actuators, cylinders, and motors 70 and/or one or more of the machine portion or implement 72 may include electronic position sensors 80. The electronic position sensors 80 transmit information regarding the position of its respective hydraulic actuator, cylinder, or motor 70, or a machine portion or an implement 72 to the controller 76. In this manner, the controller 76 can, for example, determine the current angle of the blade 24 of the machine 10 and change the position the blade 24.

Each of the one or more electro-hydraulic actuators 63 may include an electrical drive solenoid 82 and a pilot hydraulic valve 84. The solenoid 82 receives control signals from the controller 76 and produces a controlled mechanical movement of the armature (not shown) of one or more of the electro-hydraulic actuators 63. The pilot hydraulic valve 84 receives both the controlled mechanical movement of the armature (not shown) of the electro-hydraulic actuator 63 and low pilot pressure from the hydraulic pressure reducing valve 68 and routes controlled pilot hydraulic pressure to the main hydraulic valve 62 or back to the reservoir 67. The pilot hydraulic pressure is routed to the main hydraulic valve 62 to act upon the movable valve member 64 to change position of the movable valve member 64 in order to selectively route hydraulic fluid to the one or more hydraulic actuators, cylinders, and motors 70.

Figure 4:
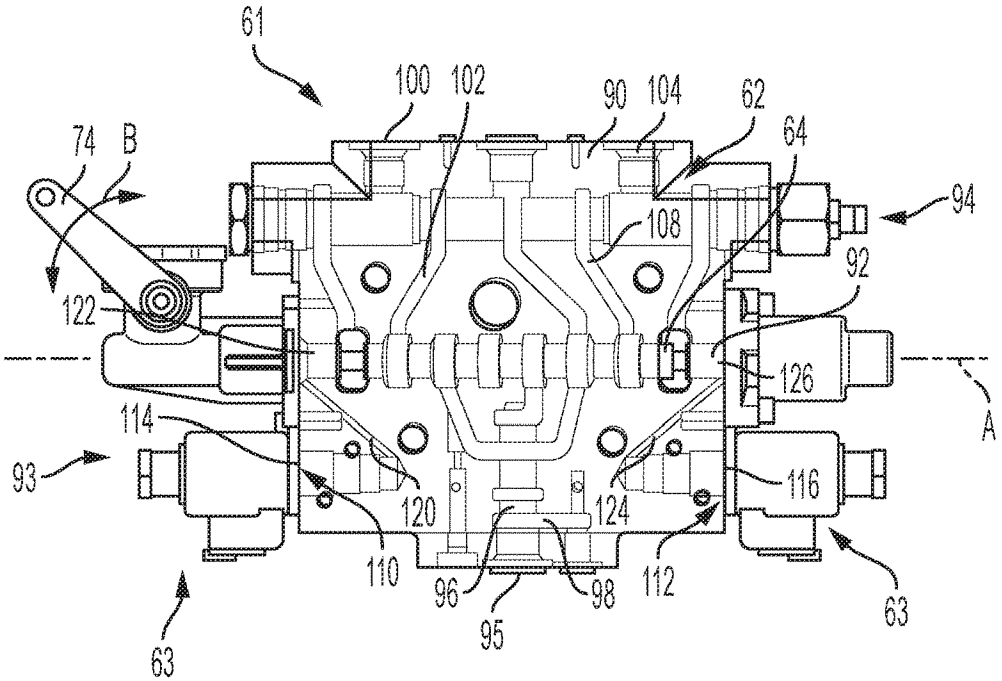
FIG. 4 is a sectional view of hydraulic valve arrangement of FIG. 3.

FIG. 4 is a cross-sectional view of an exemplary embodiment of the hydraulic valve assembly 61, including the main hydraulic valve 62 and a pair of electro-hydraulic actuators. The main hydraulic valve 62 includes a valve body 90. The valve body 90 may be configured in a variety of ways, including having a plurality of internal passages for selectively routing high pressure hydraulic fluid through the valve body 90. In the illustrated embodiment, the valve body 90 includes a cavity 92 which extends along a longitudinal axis A of the valve body 90 from a first side 93 to a second side 94 opposite the first side 93. The valve member 64 is disposed within the cavity 92 for axially movement therein along the longitudinal axis A.

The valve body 90 includes a high-pressure inlet port 95 in fluid communication with the cavity 92 via a first high-pressure inlet passage 96. A dump passage 98 fluidly connects the first high-pressure inlet passage 96 to the reservoir 67. The valve body 90 also includes a first high-pressure outlet port 100 in fluid communication with the cavity 92 via a first high-pressure outlet passage 102 and a second high-pressure outlet port 104 in fluid communication with the cavity 92 via a second high-pressure outlet passage 108.

The valve body 90 further includes a first pilot pressure inlet port 110 and a second pilot pressure inlet port 112. In the illustrated embodiment, the first pilot pressure inlet port 110 is positioned opposite the second pilot pressure inlet port 112 on the valve body 90. In other embodiments, however, the first pilot pressure inlet port 110 may not be opposite the second pilot pressure inlet port 112.

In the illustrated embodiment, the one or more electro-hydraulic actuators 63 are a pair of electro-hydraulic actuators 63. Other embodiments, however, may include more or less than two electro-hydraulic actuators 63. Each of the electro-hydraulic actuators 63 is fixably connected to the valve body 90. For the purposes of this disclosure the phrase fixedly connected may include bolted to, integrally formed with, or otherwise rigidly adjoined to. In other embodiments, however, each of the electro-hydraulic actuators 63 may be separate from and fluidly connected the valve body 90.

In the illustrated embodiment, the valve body 90 includes a first actuator mounting surface 114 adapted to mount one of the electro-hydraulic actuators 63 onto the valve body 90 such that the pilot hydraulic valve 84 on the one electro-hydraulic actuator 63 is in fluid communication with the first pilot pressure inlet port 110. Similarly, the valve body 90 includes a second actuator mounting surface 116 adapted to mount the other electro-hydraulic actuator 63 onto the valve body 90 such that the pilot hydraulic valve 84 on the other electro-hydraulic actuator 63 is in fluid communication with the second pilot pressure inlet port 112.

The first pilot pressure inlet port 110 is in fluid communication with the cavity 92 via a first pilot pressure passage 120. The valve member 64 includes a first engagement surface 122 facing toward the first side 93 of the valve body 90. The first engagement surface 122 may be configured in a variety of ways. Any surface that the pilot pressure can act on to move the valve member 64 axially toward the second side 94 may be used. In the illustrated embodiment, the first engagement surface 122 is an annular shoulder on the valve member 64 adjacent to or near the first side 93. The first pilot pressure passage 120 is configured to direct pilot pressure to the first engagement surface 122 to act thereon.

The second pilot pressure inlet port 112 is in fluid communication with the cavity 92 via a second pilot pressure passage 124. The valve member 64 includes a second engagement surface 126 facing the second side 94 of the valve body 90. The second engagement surface 126 may be configured in a variety of ways. Any surface that the pilot pressure can act on to move the valve member 64 axially toward the first side 93 may be used. In the illustrated embodiment, the second engagement surface 126 is an annular shoulder on the valve member 64 adjacent to or near the second side 94. The second pilot pressure passage 124 is configured to direct pilot pressure to the second engagement surface 126 to act thereon.

INDUSTRIAL APPLICABILITY

The presently disclosed electro-hydraulic control system 60 may be applicable to a variety of applications, including machines, such as excavators, backhoes, loaders, and motor graders. For example, a motor grader may include a variety of hydraulic actuators, cylinders, and motors 70 that receive high hydraulic pressure to produce mechanical force to move a portion of the machine or an implement 72. The disclosed electro-hydraulic control system 60 includes the hydraulic valve assembly 61 configured for both manual control and automatic control. In the disclosed embodiment, the main hydraulic valve 62 is configured to be actuated both by a mechanical interface 74 and by hydraulic pilot pressure, thus providing operational flexibility with minimal or no additional valves, wiring, controllers, and hydraulic lines.

For the exemplary embodiment, in operation, the main hydraulic valve 62 is switchable between a first state, a second state, and a third state. In the first state, high-pressure hydraulic fluid is routed through the first high-pressure outlet passage 102 to the first high-pressure outlet port 100 while the second high-pressure outlet passage 108 and the dump passage 98 are blocked. In the second state, high pressure hydraulic fluid is routed through the dump passage 98 back to the reservoir 67 while the first high-pressure outlet passage 102 and the second high-pressure outlet passage 108 are blocked. In the third state, high pressure hydraulic fluid is routed through the second high-pressure outlet passage 108 to the second high-pressure outlet port 104 while the first high-pressure outlet passage 102 and the dump passage 98 are blocked. To switch between the first state, the second state, and the third state, the valve member 64 is moved between a first valve position, a second valve position, and a third valve position, respectively. In the illustrative embodiment, the valve member 64 is in the first valve position when it is closest to the first side 93, the valve member 64 is in the third valve position when it is closest to the second side 94, and the valve member 64 is in the second valve position when it is in a centrally located between the first valve position and the third valve position. Other arrangements, however, are also possible.

As indicated above, the mechanical interface 74 is mechanically linked to the movable valve member 64 to change the position of the movable valve member 64. Referring to FIG. 4, the mechanical interface 74 is pivotal in both a clockwise and counterclockwise direction as shown by arrow B. In the illustrated embodiment, pivoting the mechanical interface 74 clockwise moves the valve member 64 axially toward the first side 93 and pivoting the mechanical interface 74 counterclockwise moves the valve member 64 axially toward the second side 94. The mechanical interface 74 may have different positions the correspond to the different valve positions. For example, the mechanical interface 74 may have a first interface position corresponding to the first valve position, a second interface position corresponding to the second valve position, and a third interface position corresponding to the third valve position.

For pilot control of the main hydraulic valve 62, one of the electro-hydraulic actuators 63 is mounted to the first actuator mounting surface 114 of the valve body 90 such that the pilot hydraulic valve 84, when opened, may route low pilot pressure hydraulic fluid into the first pilot pressure passage 120. The electrical drive solenoid 82 is operatively coupled to the pilot hydraulic valve 84 to selectively open and close the pilot hydraulic valve 84.

Similarly, a second of the electro-hydraulic actuators 63 is mounted to the second actuator mounting surface 116 of the valve body 90 such that the pilot hydraulic valve 84 of the second of the electro-hydraulic actuators 63, when opened, may route low pilot pressure hydraulic fluid into the second pilot pressure passage 124. The electrical drive solenoid 82 of the second of the electro-hydraulic actuators 63 is operatively coupled to the corresponding pilot hydraulic valve 84 to selectively open and close the pilot hydraulic valve 84.

Each of the electrical drive solenoids 82 is communicatively coupled to the controller 76 such that the controller 76 may send a signal to selectively energize the electrical drive solenoid 82 to actuate the pilot hydraulic valve 84 of the electro-hydraulic actuators 63. The controller 76 may be configured to actuate the electrical drive solenoid 82 in response to a variety of factors. In one embodiment, the controller 76 may actuate the solenoid in response to receiving a signal from the one or more of the electronic position sensors 80. For example, the hydraulic valve assembly 61 may control high pressure hydraulic pressure to the right lift cylinder 38 to raise and lower the right end of blade 24. The first high-pressure outlet port 100 may be fluidly coupled to the right lift cylinder 38 to extend the cylinder and the second high-pressure outlet port 104 may be fluidly coupled to the right lift cylinder 38 to retract the cylinder. The controller 76 may receive a signal from an electronic position sensor 80 associated with the right lift cylinder 38 or with the blade 24 that is indicative of the position of the blade 24. The controller 76 may then, based on functions, steps, routines, data tables, data maps, charts and the like saved in any type of computer-readable medium, actuate one of the electro-hydraulic actuators 63 to open one of the pilot hydraulic valve 84 to route pilot pressure hydraulic fluid to move the valve member 64. Movement of the valve member 64 results in the main hydraulic valve 62 routing high pressure hydraulic fluid to the right lift cylinder 38 to extend or retract the cylinder.

The one or more electro-hydraulic actuators 63 and the mechanical interface 74 are both operatively coupled to the valve member 64 to selectively move the valve member 64. Thus, the electro-hydraulic actuators 63 and the mechanical interface 74 may be described as being operatively coupled to the valve member 64 in series such that automatic movement of the movable valve member 64 between the first valve position and the second valve position by the one or more electro-hydraulic actuators 63 also moves the mechanical interface 74 from the first interface position to the second interface position. As shown schematically in FIG. 3, in the illustrated embodiment, the valve member 64 of the main hydraulic valve 62 is biased to return to the second position and the hydraulic valve assembly 61 is configured for infinitely-variable control.

It will be apparent to those skilled in the art that various modifications and variations can be made to the hydraulic system and hydraulic valve assembly of the present disclosure without departing from the scope of the disclosure. Other embodiments will be apparent to those skilled in the art from consideration of the specification and practice of the hydraulic valve assembly disclosed herein. It is intended that the specification and examples be considered as exemplary only, with a true scope of the disclosure being indicated by the following claims and their equivalent.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

ELEMENT LIST

Element Number Element Name
10 machine
12 power source
14 linkage arrangement
16 operator station
20 front frame
22 rear frame
24 blade
25 top portion
26 cutting edge
27 ground surface
28 tires
30 steering wheel
32 hand controls
34 drawbar
38 right lift cylinder
42 center shift cylinder

46 hydraulic blade tip cylinder
48 circle gear
50 hydraulic motor drive
60 exemplary electro-hydraulic control system
61 single hydraulic valve assembly
62 main hydraulic valve
63 electro-hydraulic actuators
64 movable valve member
66 hydraulic pumps
67 reservoir
68 hydraulic pressure reducing valve
70 motors
72 implement
74 mechanical interface
76 controller
80 electronic position sensors
82 electrical drive solenoid
84 pilot hydraulic valve
90 valve body
92 cavity
95 high-pressure inlet port
96 first high-pressure inlet passage
98 dump passage
100 first high-pressure outlet port
102 first high-pressure outlet passage
104 second high-pressure outlet port
108 second high-pressure outlet passage
110 first pilot pressure inlet port
112 second pilot pressure inlet port
114 first actuator mounting surface
116 second actuator mounting surface
120 first pilot pressure passage
122 first engagement surface
124 second pilot pressure passage
126 second engagement surface

What is claimed is:

1. A hydraulic valve assembly, comprising:

a main control valve having a valve body housing a valve member that is movable between a first valve position, a second valve position, and a third valve position, wherein the valve body includes a pilot pressure fluid passage, a high pressure fluid inlet passage, and a high pressure fluid outlet passage, and wherein the valve member includes an engagement surface;

a mechanical interface operatively coupled to the movable valve member to manually move the movable valve member between the first valve position, the second valve position, and the third valve position; and one or more electro-hydraulic actuators operatively coupled to the movable valve member to automatically move the movable valve member to the first valve position in response to receiving a first control signal from a controller and to the third valve position in response to receiving a second control signal from the controller;

wherein the movable valve member is biased to return to the second valve position; and wherein the hydraulic valve assembly is configured for infinitely-variable control; and wherein the one or more electro-hydraulic actuators includes a first electro-hydraulic actuator arranged to route pilot pressure hydraulic fluid via the pilot pressure fluid passage to act upon the engagement surface to move the movable valve member to the third valve position to place the high pressure fluid inlet passage in fluid communication with the high pressure fluid outlet passage.

2. The hydraulic valve assembly of claim 1, wherein each of the one or more electro-hydraulic actuators includes an electrical drive solenoid and a pilot hydraulic valve.

3. The hydraulic valve assembly of claim 2, wherein the electrical drive solenoid is operatively coupled to the pilot hydraulic valve to open the pilot hydraulic valve.

4. The hydraulic valve assembly of claim 1, wherein the one or more electro-hydraulic actuators include a first electro-hydraulic actuator operatively coupled to the movable valve member to move the movable valve member to the third valve position and a second electro-hydraulic actuator operatively coupled to the movable valve member to move the movable valve member to the first valve position.

5. The hydraulic valve assembly of claim 4, wherein the valve body includes a second pilot pressure fluid passage and the valve member includes a second engagement surface, and wherein the second electro-hydraulic actuator is arranged to route pilot pressure hydraulic fluid via the second pilot pressure fluid passage to act upon the second engagement surface to move the valve member to the first valve position to place the high pressure fluid inlet passage in fluid communication with a second high pressure fluid outlet passage.

6. The hydraulic valve assembly of claim 5, wherein the valve body includes a first side and a second side opposite the first side, and wherein the first engagement surface is adjacent the first side and the second engagement surface is adjacent the second side.

7. The hydraulic valve assembly of claim 1, wherein the mechanical interface moves from a first interface position to a second interface position when manually moving the movable valve member from the first valve position and the second valve position, and moves from the second interface position to a third interface position when manually moving the movable valve member from the second valve position and the third valve position, and wherein automatic movement of the movable valve member from the first valve position and the third valve position by the one or more electro-hydraulic actuators moves the mechanical interface from the first interface position to the third interface position.

8. A hydraulic system for a machine, the system comprising:

a hydraulic pump;

a main control valve configured to receive high pressure hydraulic fluid from the hydraulic pump and route the high pressure hydraulic fluid to one of a hydraulic actuator, a hydraulic cylinder, or a hydraulic motor, the main control valve having a valve body and a valve member movable within the valve body between a first valve position, a second valve position, and a third valve position, wherein the valve body includes a pilot pressure fluid passage and the valve member includes an engagement surface;

a mechanical interface operatively coupled to the movable valve member to manually move the movable valve member between first valve position, the second valve position, and the third valve position;

one or more electro-hydraulic actuators operatively coupled to the movable valve member to automatically move the movable valve member to the first valve position in response to receiving a first control signal and to the third valve position in response to receiving a second control signal; and a controller communicatively coupled to the one or more electro-hydraulic actuators and configured to selectively send the first and second control signals to the one or more electro-hydraulic actuators;

wherein the movable valve member is biased to return to the second valve position;

wherein the hydraulic valve assembly is configured for infinitely-variable control; and wherein the one or more electro-hydraulic actuators includes a first electro-hydraulic actuator arranged to route pilot pressure hydraulic fluid via the pilot pressure fluid passage to act upon the engagement surface to move the movable valve member to the second valve position in order to route high pressure hydraulic fluid to the one of a hydraulic actuator, a hydraulic cylinder, or a hydraulic motor.

9. The hydraulic system of claim 8, wherein each of the one or more electro-hydraulic actuators includes an electrical drive solenoid and a pilot hydraulic valve.

10. The hydraulic system of claim 9, wherein the electrical drive solenoid is operatively coupled to the pilot hydraulic valve to open the pilot hydraulic valve.

11. The hydraulic system of claim 8, wherein the valve body includes a second pilot pressure fluid passage and the valve member includes a second engagement surface, and wherein the one or more electro-hydraulic actuators include a second electro-hydraulic actuator arranged to route pilot pressure hydraulic fluid via the second pilot pressure fluid passage to act upon the second engagement surface to move the valve member to the first valve position in order to route high pressure hydraulic fluid to the one of a hydraulic actuator, a hydraulic cylinder, or a hydraulic motor.

12. The hydraulic system of claim 11, wherein the valve body includes a first side and a second side opposite the first side, and wherein the first engagement surface is adjacent the first side and the second engagement surface is adjacent the second side.

13. The hydraulic system of claim 8, wherein the mechanical interface moves from a first interface position to a second interface position when manually moving the movable valve member from the first valve position and the second valve position, and moves from the second interface position to a third interface position when manually moving the movable valve member from the second valve position and the third valve position, and wherein automatic movement of the movable valve member from the first valve position and the third valve position by the one or more electro-hydraulic actuators moves the mechanical interface from the first interface position to the third interface position.

14. The hydraulic system of claim 8, wherein the controller sends the first control signal in response to receiving a signal from one or more position sensors.

15. The hydraulic system of claim 14, wherein the one or more position sensors are configured to send a signal indicative of the position of one of a hydraulic actuator, a hydraulic cylinder, a hydraulic motor or a machine implement.

16. A method of controlling a hydraulic control valve having a movable valve member movable within a valve body of the control valve between a first valve position, a second valve position, and a third valve position, comprising:

operatively coupling a mechanical interface to a movable valve member;

fluidly coupling a pilot hydraulic valve with the valve member;

operatively coupling an electric drive solenoid to the pilot hydraulic valve; and moving the movable valve member to route high pressure hydraulic fluid through the valve body, from the second valve position to the first valve position by one of manually moving the mechanical interface to a first interface position from a second interface position or by actuating the electric drive solenoid to open the pilot hydraulic valve to direct pilot pressure hydraulic fluid to act on an engagement surface of the movable valve member within the valve body, wherein the movable valve member is biased to return to the second valve position; and wherein the hydraulic valve assembly is configured for infinitely-variable control.

17. The method of claim 16, further comprising fluidly coupling a second pilot hydraulic valve with the valve member, operatively coupling a second electric drive solenoid to the second pilot hydraulic valve, and moving the movable valve member from the second valve position to the third valve position by actuating the second electric drive solenoid to open the second pilot hydraulic valve to direct pilot pressure hydraulic fluid to act on a second engagement surface of the movable valve member within the valve body.

18. The method of claim 16, wherein the electric drive solenoid is actuated automatically in response to a control signal from a controller.

* * * * *